US005467574A

United States Patent [19]

Thomsen

[11] Patent Number: 5,467,574

[45] Date of Patent: Nov. 21, 1995

[54] STACKING AND CARRYING DEVICE

[76] Inventor: John E. Thomsen, 1621 116th St., Kenosha, Wis. 53140

[21] Appl. No.: 388,123

[22] Filed: Feb. 13, 1995

Related U.S. Application Data

[60] Continuation of Ser. No. 295,963, Aug. 25, 1994, abandoned, which is a division of Ser. No. 175,056, Dec. 28, 1993, Pat. No. 5,381,895.

[51] Int. Cl.[6] ..... B65B 35/50; B65B 39/00

[52] U.S. Cl. ..... 53/397; 53/246; 53/255; 53/447; 53/475

[58] Field of Search ..... 53/447, 443, 457, 53/473, 397, 246, 263, 255, 540, 539, 531; 206/500, 499, 315.9, 45.14; 211/14

[56] References Cited

U.S. PATENT DOCUMENTS

| | | | |
|---|---|---|---|
| 479,650 | 7/1892 | Longenecker | 53/255 X |
| 1,201,441 | 10/1916 | Clinger . | |
| 1,992,871 | 2/1935 | Livingston | 53/255 X |
| 2,083,973 | 6/1937 | Zimmerman | 206/44 |
| 2,833,095 | 5/1958 | Stuart | 53/246 X |
| 2,893,550 | 7/1959 | Sandmeyer | 53/447 X |
| 3,198,338 | 8/1965 | McCormick | 211/14 |
| 3,302,843 | 2/1967 | Sheehan | 206/315.9 X |
| 4,103,773 | 8/1978 | Haber | 206/315 B |
| 4,214,684 | 7/1980 | Galowitz | 206/315.9 X |
| 4,561,547 | 12/1985 | Estwanik | 211/14 |
| 4,892,197 | 1/1990 | Slattery et al. | 211/14 |

FOREIGN PATENT DOCUMENTS

| | | | |
|---|---|---|---|
| 403223 | 12/1967 | Australia | 294/159 |

*Primary Examiner*—James F. Coan
*Attorney, Agent, or Firm*—Quarles & Brady

[57] ABSTRACT

A stacking and carrying device for spherical objects such as golf balls wherein a tray member supports the spherical objects in the form of a pyramid and has strap members for carrying the tray. A filling device is also provided which stacks the balls on the tray member in a pyramidal fashion automatically and without any orientation. The filling device and method disclosed afford use in an automated dispensing machine such as for use on a golf practice range.

12 Claims, 2 Drawing Sheets

STACKING AND CARRYING DEVICE

This is a continuation of application Ser. No. 08/295,963 filed Aug. 25, 1994, now abandoned, which is a division of Ser. No. 08/175,056 filed Dec. 28, 1993, now U.S. Pat. No. 5,381,895.

BACKGROUND OF THE INVENTION

This invention relates to a support for spherical objects stacked in a pyramidal configuration as well as a device and method for such stacking. It also relates to a tray device for carrying spherical objects such as golf balls.

It is known in the prior art to place spherical objects in the form of a pyramid on a support. For example, U.S. Pat. No. 1,201,441 shows a tray 1 with perforations 5 for this purpose. A device for stacking pool balls in the form of a truncated pyramid is described in U.S. Pat. No. 4,103,773. A display device for stacking spherical objects is illustrated in U.S. Pat. No. 2,083,973.

The prior art does not provide a tray device for transporting spherical objects. Neither does the prior art afford a method of placing spherical objects in a pyramidal configuration or a device for accomplishing it.

It is an advantage of the invention to provide a tray member for transporting spherical objects in a pyramidal configuration.

It is another advantage of the invention to provide a filling device for stacking spherical objects in a pyramidal configuration on a support.

It is yet another advantage of the invention to provide an improved method for stacking the spherical objects on a support.

It is still another advantage of the invention to provide a carrying tray and filling device for golf balls which affords automatic filling.

It is yet another advantage of the invention to provide a tray member and filling device of the foregoing type which are economical to manufacture, and in the instance of the filling device and tray member, are easy to use.

SUMMARY OF THE INVENTION

The foregoing advantages are accomplished by the present stacking and carrying device for spherical objects such as golf balls which includes a tray member having a plurality of continuous apertures aligned in rows and in a square orientation. Each aperture is constructed in the form of a partial sphere to receive a portion of the spherical object. A plurality of the spherical objects fills each of the apertures and is arranged in a pyramid above those spherical objects positioned in all of the apertures. Strap members are connected to opposite sides of the tray member and extend over the pyramidal arrangement of the spherical objects for carrying purposes.

In a preferred embodiment, the spherical objects are golf balls.

In one aspect, each of the strap members comprises two leg portions and includes a connecting member for holding the strap members together above the pyramidal arrangement.

In another aspect, there is provided a filling device for automatically placing the spherical objects on a tray member and in a pyramidal configuration. The filling device has a body member with first and second sections opened at the top and bottom with one of the sections in the form of a partial pyramid. The other section is connected to the first section to receive the spherical objects.

In still another aspect, there is provided a method of stacking spherical objects on the previously described tray using the previously described filling device. A support is placed on a supporting surface with the support having a square configuration and a plurality of continuous apertures aligned in rows and in a square orientation. Each aperture is constructed in the form of a partial sphere to receive a portion of the spherical object. The filling device is positioned over the support with the support beneath the pyramidal section. Spherical objects are flowed into the filling device from the top and automatically fill the support in the form of a pyramid.

BRIEF DESCRIPTION OF THE DRAWINGS

A better understanding of the present stacking and carrying device, as well as the filling device and method of use, will be accomplished by reference to the drawing wherein.

DESCRIPTION OF THE EMBODIMENTS

Figure 1:
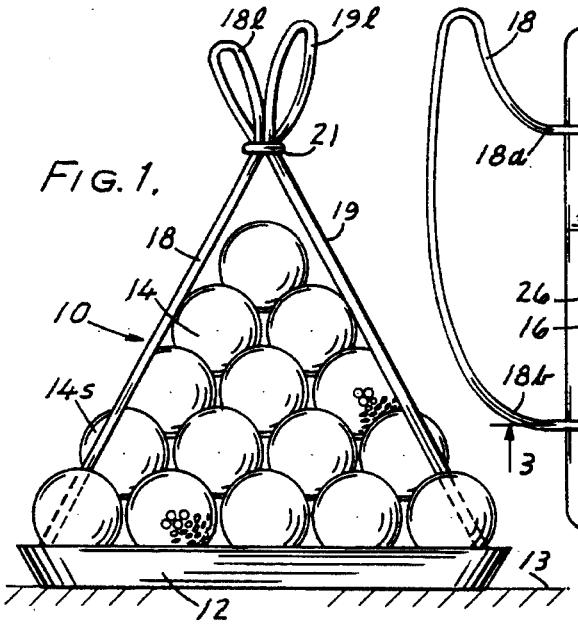
FIG. 1 is a view in side elevation showing the stacking and carrying device for spherical objects.
Figure 2:
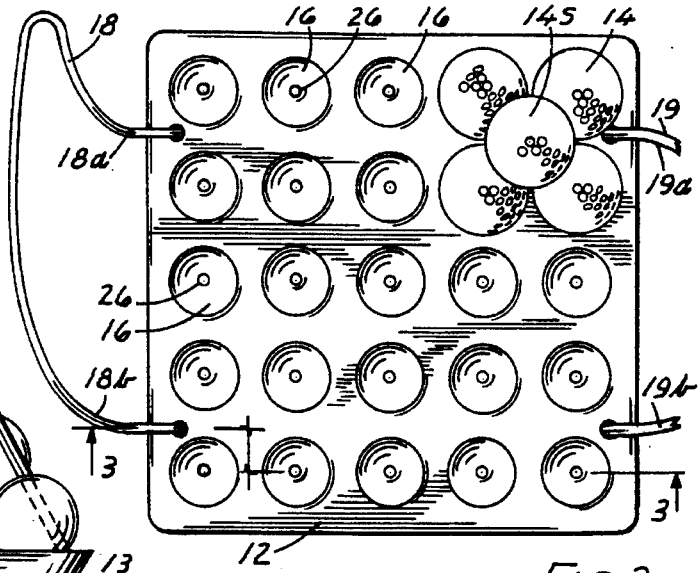
FIG. 2 is a top plan view of the tray of FIG. 1 with most of the spherical objects removed.
Figure 3:
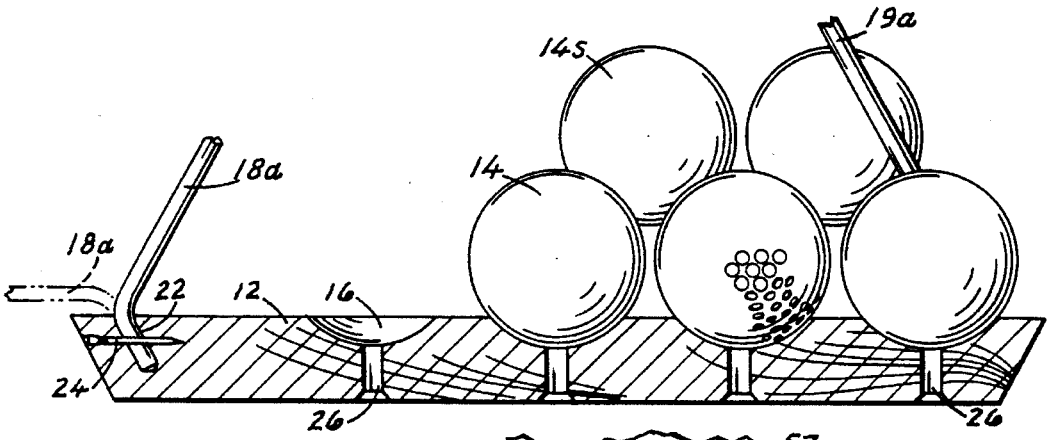
FIG. 3 is a view in vertical section taken along line 3—3 of FIG. 2.

Proceeding to a detailed description of the present invention, and particularly FIGS. 1–3, the stacking and carrying device, generally 10, includes a tray member 12 such as shown on a support surface 13. A plurality of spherical objects 14 is shown stacked on the tray in the form of a pyramid. The tray member 12 has the multiplicity of apertures 16 in the form of partial spheres to accommodate the spherical objects 14. Drainage holes are indicated at 26. In order to form the desired pyramid of spherical objects, the base row of spherical objects 14 as seated in the apertures 16 must be in a square pattern. Thus, in the embodiment shown in FIG. 2, there are five rows of five apertures aligned in a square orientation or pattern. As indicated in FIG. 2, a second row of balls as shown at **14*s* is supported by four balls seated directly on the tray member 12. The remaining balls are then stacked on succeeding rows to result in a pyramidal formation as shown in FIG. 1**.

Secured to opposite sides of the tray member 12 are straps 18 and 19 each having two leg portions **18*a*, 18*b*, 19*a* and 19*b* which are secured to the tray such as by the channels 22 and a nail 24. The straps are brought together at the top of the pyramidal stacking of the spherical objects 14 and secured together by a clip 21. This results in loops 181 and 191 for ease in carrying of the tray and the spherical objects 14**.

A filling device, generally 30, is shown in FIGS. 4–7. The filling device is formed in an hourglass configuration from an upper four walled section having a front wall 32, side walls 33 and 34, as well as a back wall 35, to provide a hopper portion. A curved wall portion is shown at 37 at the front. There is also a lower four walled section in the form of a partial pyramid. It has a front wall 40, side walls 41 and 42, as well as a back wall 43. The upper walls 32–35 are held together by the straps 45 and rivets 47, and in a similar manner, the lower walls 40–43 are held together by straps 46 and rivets 47.

Figure 5:
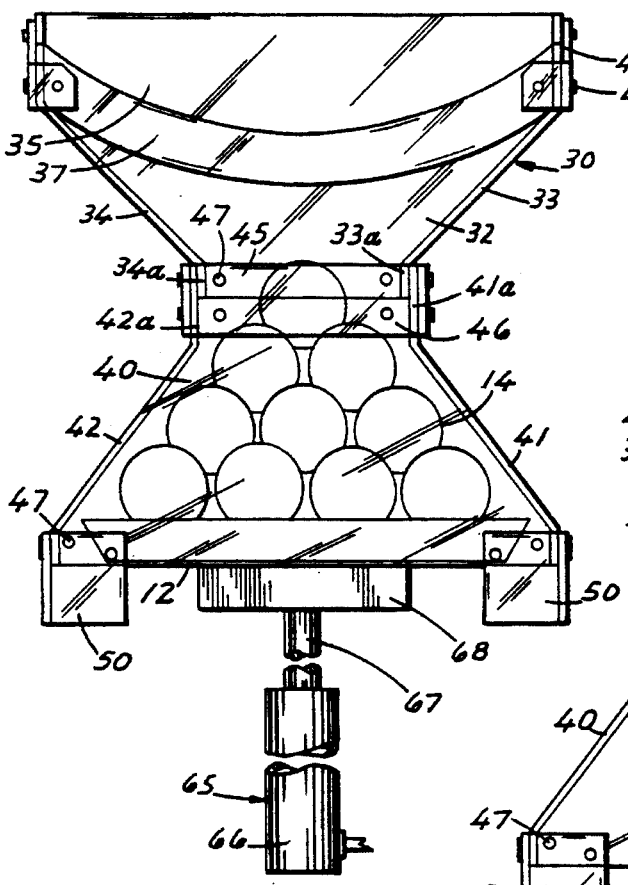
FIG. 5 is a view similar to FIG. 4 showing the filling device with a tray holding apparatus.

As best seen in FIG. 5, the walls have angled leg portions such as shown at 33*a* and 34*a*, as well as 41*a* and 42*a* to provide a nesting of the upper walls with the lower walls. The upper walls are joined at the corners by the corner connectors 48 and 49, as well as the rivets 47. The bottom walls also have feet 50 connected thereto which also are riveted at 47.

Figure 4:
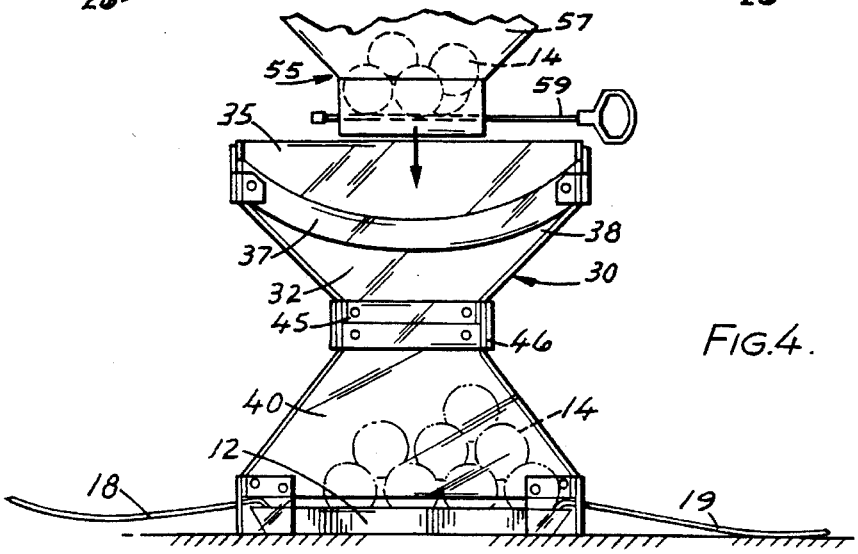
FIG. 4 is a view in side elevation illustrating a filling device for placing the spherical objects on the tray.

Referring specifically to FIG. 4, the method of stacking spherical objects on a support in the form of a pyramid is illustrated. A tray 12 is shown positioned within the lower pyramidal section of the filling device 30. At the upper end of the filling device, there is a dispensing apparatus, generally 55. It would include a hopper section 57 and a dispenser gate device 59 which when rotated would allow the balls 14 to pass therethrough into an upper filling section 38 of the filling device 30. An important aspect of the lower walls 40–43 of the filling device 30 is the fact that they are angled and inclined upwardly in a manner to form a partial pyramid. Thus, when the balls 14 fall from the dispenser 55 into the filling device 30, the initial balls 14 fill the cavities 16 in the tray member 12, and after this initial filling, the balls fill the next row, then the third, fourth and the top row of a single ball, all automatically without any hand orientation or external force being applied.

As illustrated in FIG. 5, the filling device 30 with the bottom partial pyramid configuration is constructed so that it can accommodate different tray sizes with varying numbers of apertures for balls. For example, a small tray such as one with sixteen apertures to accommodate sixteen balls on four rows of four apertures, would be positioned at an inner portion of the lower section of the filling device and between the lower walls 40–43, whereas a larger tray such as one with twenty-five holes would be accommodated just inside the confines of these walls as shown in FIG. 5. The positioning of the various tray member sizes is effected by the raising and lowering mechanism generally 65. It includes a hydraulic cylinder 66 with the usual piston arm 67 and a platform member 68 to engage the tray member 12. In this embodiment, the filling device 30 would be supported laterally such as with connections to the feet 50 so that the filled tray member 12 can clear the bottom of the filling device 30. The stroke of the piston arm 67 would be sufficient to allow this clearance.

Considering FIGS. 4 and 5 together, it can be appreciated that the filling device lends itself to an automatic dispensing machine wherein the dispensing apparatus 55 could be automated such as with the use of a microprossor to determine the number of balls to be dropped in conjunction with the number of apertures in the tray member 12. Further, the platform member 68 would automatically position the tray member to the desired height within the bottom section of the filling device 30 which can be made in various capacities to receive tray members of various sizes. Such an automated operation would be useful in conjunction with a golf ball practice range.

As indicated previously, the tray member 12 can have a variety of apertures arranged in rows which have a square orientation. For example, the tray member could also include sixteen, thirty-six, forty-nine and sixty-four apertures and would preferably have a size of seven, eleven, thirteen and fifteen inches to the side, respectively. Tray member 12 as shown with twenty-five apertures would be nine inches to the side. The previously mentioned trays would then have a total of the following amounts of golf balls when stacked in a pyramid fashion: the seven inch tray would result in thirty balls, the nine inch in fifty-five balls, the eleven inch in ninety-one balls, the thirteen inch in one hundred and forty balls, and the fifteen inch in two hundred and four balls. Thus, the stacking and carrying device tray is very versatile in its usage with the number of balls. Another feature of the tray device is the fact that when the strap members are Joined together as shown in FIG. 1, the tray can be swung in an arcuate manner up to a forty-five degree angle with respect to the ground without any of the balls being displaced. This swinging motion has an advantage of simulating the swinging action of a golf swing.

It will thus be seen that there is now provided a unique carrying and stacking tray for spherical objects such as golf balls which is simple in its construction, yet has an aesthetic appeal. A filling device is also provided which can be fully automated and can in turn be utilized with an automated dispensing apparatus.

While the stacking and carrying device, as well as the filling device and the method described herein, have been disclosed for use in conjunction with golf balls, it will be appreciated that it could be utilized in conjunction with any spherical objects as long as they have an essentially uniform spherical dimension. The upper section of the filling device has been shown with a curved wall 37. This is for the purpose of accommodating the upper portion of a round container of golf balls for a hand filling operation. It could be eliminated and the upper walls all formed of the same dimension or could be sloped at the top. In addition, the upper and lower walls of the filling device are connected in a manner to provide a telescoping of them together and in a friction fit manner so that the upper section is easily removed. If desired, the upper section could be fastened to the lower section in a permanent manner. While a particular dispensing apparatus 55 is disclosed with the filling device 30, it, as well as the filling section 38, could be replaced with a gravity feeding system employing a spiral pathway. Alternatively, the dispensing apparatus can be eliminated and still afford the advantages of the filling device by a hand filling operation. Such a hand filling operation could include a hinged wall such as lower front wall 40 to allow the tray member 12 with golf balls 14 to be removed. A slotted side wall could also be used for placement of an empty tray member 12 therebetween. However, this would require an upward removal movement of the filling device 30 therefrom. The preferred materials for forming the filling device is clear plastic for the walls of the filling device while the tray unit is made of wood. Obviously, other materials can be substituted.

The foregoing invention can now be practiced by those skilled in the art. Such skilled persons will know that the invention is not necessarily restricted to the particular embodiments therein. The scope of the invention is to be defined by terms of the following claims as given meaning by the preceding description.

I claim:

1. A method of stacking spherical objects on a support in the form of a pyramid comprising:

placing a support on a supporting surface, the support having an essentially square configuration with a plurality of continuous apertures aligned in rows and in a square orientation, each aperture constructed in the form of a partial sphere to receive a portion of the spherical object;

positioning a filling device over the support, the filling device having a pyramidal section and an open top and bottom, the pyramidal section being placed over the support; and flowing the spherical objects into the filling device from the top thereof.

2. The method of claim 1 wherein the filling device has a hopper portion and the round objects are initially placed in the hopper portion.

3. The method of claim 1 wherein a multiplicity of different sizes of supports are placed in the filling device.

4. The method of claim 1 wherein the support is a tray member.

5. The method of claim 1 wherein the spherical objects are golf balls.

6. A filling device for placing spherical objects on a tray member and in a pyramidal configuration, the tray member having a plurality of continuous apertures aligned in rows and in an essentially square orientation, each aperture constructed in the form of a partial sphere to receive a portion of the spherical object, said filling device comprising:

a body member having first and second sections open at both ends with one of the sections being in the form of a partial pyramid constructed and arranged to receive the tray member therein; and the other section connected to the first section to receive the spherical objects whereby the spherical objects can be stacked on the tray member in the format of a pyramid.

7. The filling device as defined in claim 6 wherein the other section has at least two walls angled outwardly from an end connected to the pyramidal section.

8. The filling device as defined in claim 7 wherein the other section has a curved wall section extending downwardly from a larger end thereof.

9. The filling device as defined in claim 6 wherein the filling device is constructed and arranged to receive tray members of various sizes.

10. The filling device as defined in claim 9 wherein the tray member has apertures having a total number comprising 16, 25, 36, 49 or 64.

11. A filling device for placing spherical objects on a tray member and in a pyramidal configuration, the tray member having a plurality of continuous apertures in rows and in a square orientation to receive a portion of the spherical objects, said filling device comprising:

a body member having a section essentially in the form of a pyramid constructed and arranged to receive the tray member at a base of the pyramid.

12. A method of stacking spherical objects on a support in the form of a pyramid, the support having a square configuration with a plurality of continuous apertures in rows and in a square orientation to receive a portion of the spherical objects, the method comprising:

flowing the spherical objects into a filling device having an essentially pyramidal configuration; and placing the support at a base of the pyramid to allow the spherical objects to flow into the apertures and form a pyramid thereon.

* * * * *

UNITED STATES PATENT AND TRADEMARK OFFICE

CERTIFICATE OF CORRECTION

PATENT NO. : 5,467,574

DATED : November 21, 1995

INVENTOR(S) : John E. Thomsen

It is certified that error appears in the above-indentified patent and that said Letters Patent is hereby corrected as shown below:

On the Title page, item [54] Title:

"STACKING AND CARRYING DEVICE" should be --METHOD AND APPARATUS FOR STACKING SPHERICAL OBJECTS--.

Column 2, line 30 "Fig. 5" should start a new paragraph.

Figure 6:
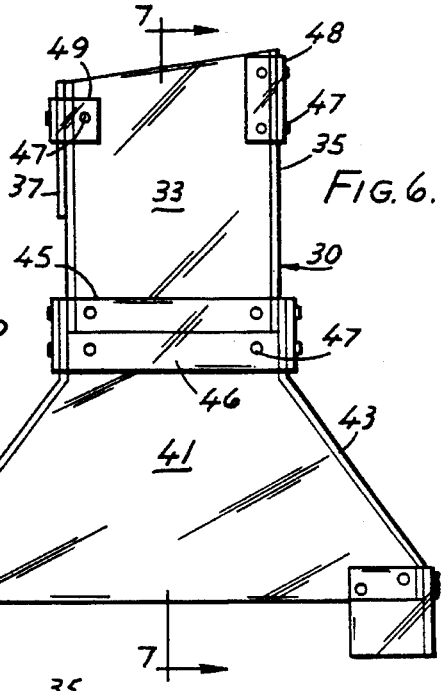
FIG. 6 is a view in side elevation of the filling device rotated ninety degrees from FIG. 5.
Figure 7:
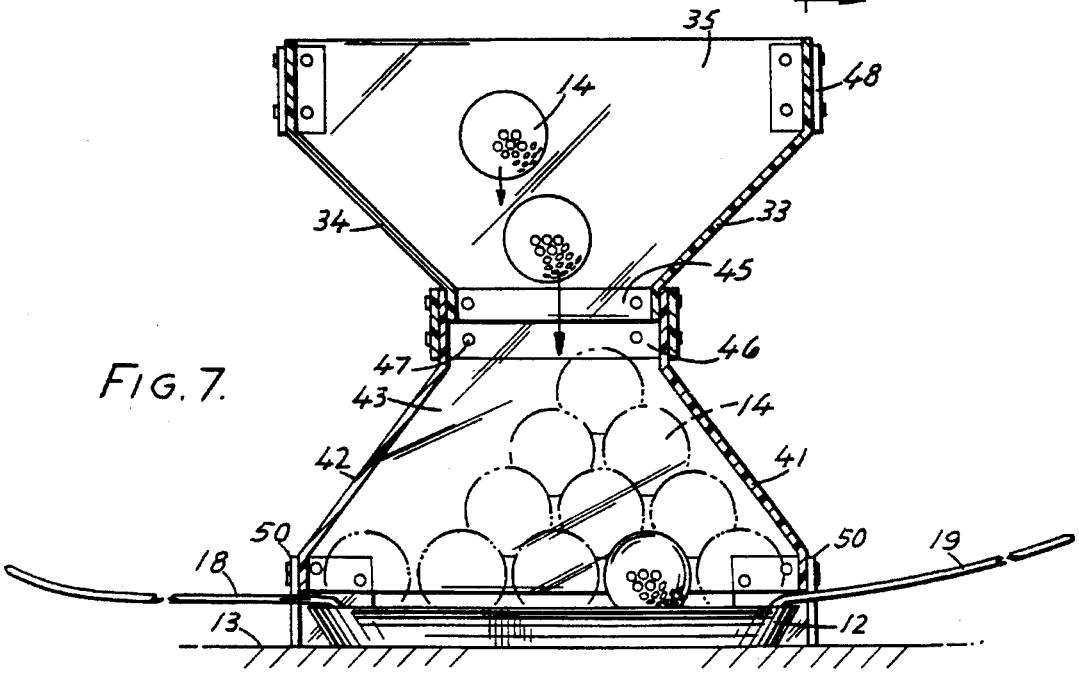
FIG. 7 is a view taken along line 7—7 of FIG. 6.

Column 2, line 32 "Fig. 6 should start a new paragraph.

Column 4, line 12 before "together" "Joined" should be --joined--.

Signed and Sealed this

Nineteenth Day of March, 199(

*Attest:*

Bruce Lehman

BRUCE LEHMAN

*Attesting Officer*

*Commissioner of Patents and Trademarks*